US008246407B2

(12) United States Patent
Roland

(10) Patent No.: US 8,246,407 B2
(45) Date of Patent: Aug. 21, 2012

(54) SURF PERCH

(76) Inventor: Vincent Roland, Rockledge, FL (US)

( * ) Notice: Subject to any disclaimer, the term of this patent is extended or adjusted under 35 U.S.C. 154(b) by 103 days.

(21) Appl. No.: 12/687,000

(22) Filed: Jan. 13, 2010

(65) Prior Publication Data

US 2011/0034096 A1 Feb. 10, 2011

Related U.S. Application Data

(63) Continuation-in-part of application No. 12/535,247, filed on Aug. 4, 2009, now abandoned.

(51) Int. Cl.
*B63C 9/08* (2006.01)

(52) U.S. Cl. ..... 441/130; 441/74

(58) Field of Classification Search ..... 405/1; 114/258; 441/65, 129, 130, 74; 297/383
See application file for complete search history.

(56) References Cited

U.S. PATENT DOCUMENTS

| | | | | | |
|---|---|---|---|---|---|
| 299,951 | A | * | 6/1884 | Brown | 441/130 |
| 1,966,343 | A | * | 7/1934 | Hallowell et al. | 297/327 |
| 2,623,574 | A | * | 12/1952 | Damsch | 297/111 |
| 3,074,084 | A | | 1/1963 | Bisch | |
| 3,102,280 | A | * | 9/1963 | Williams | 441/130 |
| 4,752,261 | A | | 6/1988 | Rosello Zoya | |
| 4,973,278 | A | | 11/1990 | Williams | |
| 5,377,607 | A | | 1/1995 | Ross | |
| 5,476,404 | A | * | 12/1995 | Price | 441/131 |
| 5,518,431 | A | * | 5/1996 | Staley | 441/130 |
| 5,897,409 | A | * | 4/1999 | Hartman et al. | 441/129 |
| 6,035,799 | A | | 3/2000 | Lukanovich et al. | |
| 6,227,925 | B1 | | 5/2001 | Boddy | |
| 6,257,944 | B1 | | 7/2001 | Herrod | |
| D465,823 | S | | 11/2002 | Lundberg | |
| 6,837,765 | B2 | | 1/2005 | Lauziere | |
| 6,918,347 | B2 | | 7/2005 | Lu et al. | |
| 7,025,418 | B1 | * | 4/2006 | Hackal | 297/217.3 |

* cited by examiner

*Primary Examiner* — Stephen Avila
(74) *Attorney, Agent, or Firm* — Browdy and Neimark, PLLC

(57) ABSTRACT

A surf perch may be configured to receive a surfboard and permits a user to insert a surfboard therein, allowing him or her to sit/float in an anchored position in the water while he or she awaits a satisfactory wave. The perch may include an octagonal hole disposed vertically therethrough, which creates a mooring system and controls the angle of the anchor line relative to that of the surf perch. Additionally, the surf perch may also include a backrest assembly, with a backrest being capable to rotate upward. Also, the surf perch may be equipped with leg protection chaps surrounding the portion of the user's legs that hang into the water.

12 Claims, 18 Drawing Sheets

SURF PERCH

This is Continuation-in-Part of copending application Ser. No. 12/535,247, filed Aug. 4, 2009, now abandoned, the contents of which are incorporated herein.

FIELD OF INVENTION

The present application relates to a flotation device, which can be and is adapted to be anchored in a body of water, and is particularly adapted to receive a surfboard on top of the device and to permit a person to sit or lie on the surfboard while on top of the device, so as to form an anchored "surf" perch for a person in the water, awaiting for an appropriate wave on which to surf. The present flotation device has other uses as well in other water environments.

BACKGROUND

A floating device may be a surfboard, a floating bed, a boat, or a floatable seat. Several U.S. patents relating to these floating devices have been issued. For example, Lukanovich, in U.S. Pat. No. 6,035,799, provides a conversion kit that transforms a surfboard into a kayak. U.S. Pat. No. 6,918,347 to Lu discloses a variable, aquatic floating kit combining a seat for sitting or reclining. U.S. Pat. No. 3,074,084 to Bisch describes a flotation device comprising a buoyant body with seat suspended from opening in the buoyant body, allowing a person to sit in the opening. Boddy, in U.S. Pat. No. 6,227,925, discloses a rigid or semi-rigid chair-like flotation device suitable for whitewater use. U.S. Pat. No. 6,257,944 to Herod describes a paddle board providing various riding positions.

Williams describes, in U.S. Pat. No. 4,973,278, a portable, floating seat comprising an inflatable tube with a joining means at each end of the tubing for temporarily uniting the discontinuous ends of the tubing and an oversized seat structure attached directly to the bottom inside of the tubing opposite the position where the discontinuous ends are temporarily joined to permit the user's legs to pass therethrough into the water. Lundberg, in U.S. Design Pat. No. D465,823, provides for a flotation chair with the seating portion and back rest depending from the U-shaped floatation portion. U.S. Pat. No. 4,752,261 to Rosello Zoya, now expired, discloses an auxiliary seat for surfboards. Lauziere, in U.S. Pat. No. 6,837,765, describes a flotation device including an elongated, buoyant body with outwardly extending seat disposed between its longitudinal ends to supports a user in either a reclined or seated position.

These prior devices are useful for their intended purposes, but none of them is suitable for providing a fixed resting place in a river, lake, or in surf, particularly the latter or in the current of a river.

SUMMARY

It is, accordingly, an object of the present invention to overcome one or more of the defects of the prior art and/or to provide a perch, preferable a SURF PERCH, which permits a user to wait in comfort in the water for a forthcoming event, such as an appropriate wave on which to surf. Alternatively, the perch of the present invention can be used in the pursuit of a number of other activities including swimming, diving, fishing, or any other water activity, as a waiting station.

According to an embodiment of the present application, a surf perch may include a main body, having a streamline shape symmetric to a centerline of the main body, two backrest supports, and a backrest adapted to swing open so as to permit the user to enter from the back of the device.

The main body may include a front side, a rear side, an upper side, forming a deck section, a bottom side, a left side, and a right side. The deck section may be configured to accommodate a surfboard and may be horizontal or instead be downwardly slanted from the front side to the rear side. Holes may be provided along the centerline of the main body. A centrally located hole may be shaped to anchor a line or rope, or other line anchoring means may be provided.

The surf perch may also include a pair of chaps or "Shark Flaps" attached e.g. on the upper side of the main body, wherein the chaps comprise two leggings respectively hanging down from the left and right side of the main body, each of which may include a footrest at its end.

The main body preferably further includes two backrest supports positioned symmetrical to the centerline of the main body, leaving a space with a first width desirably wider than the width of the deck section. A backrest is pivotably supported from and between the backrest supports at or near the upper part of the backrest.

The above objects of the present invention will become more apparent from the following detailed description of one or more embodiments of the present invention taken in conjunction with the drawings, wherein:

DETAILED DESCRIPTION

Figure 1A:
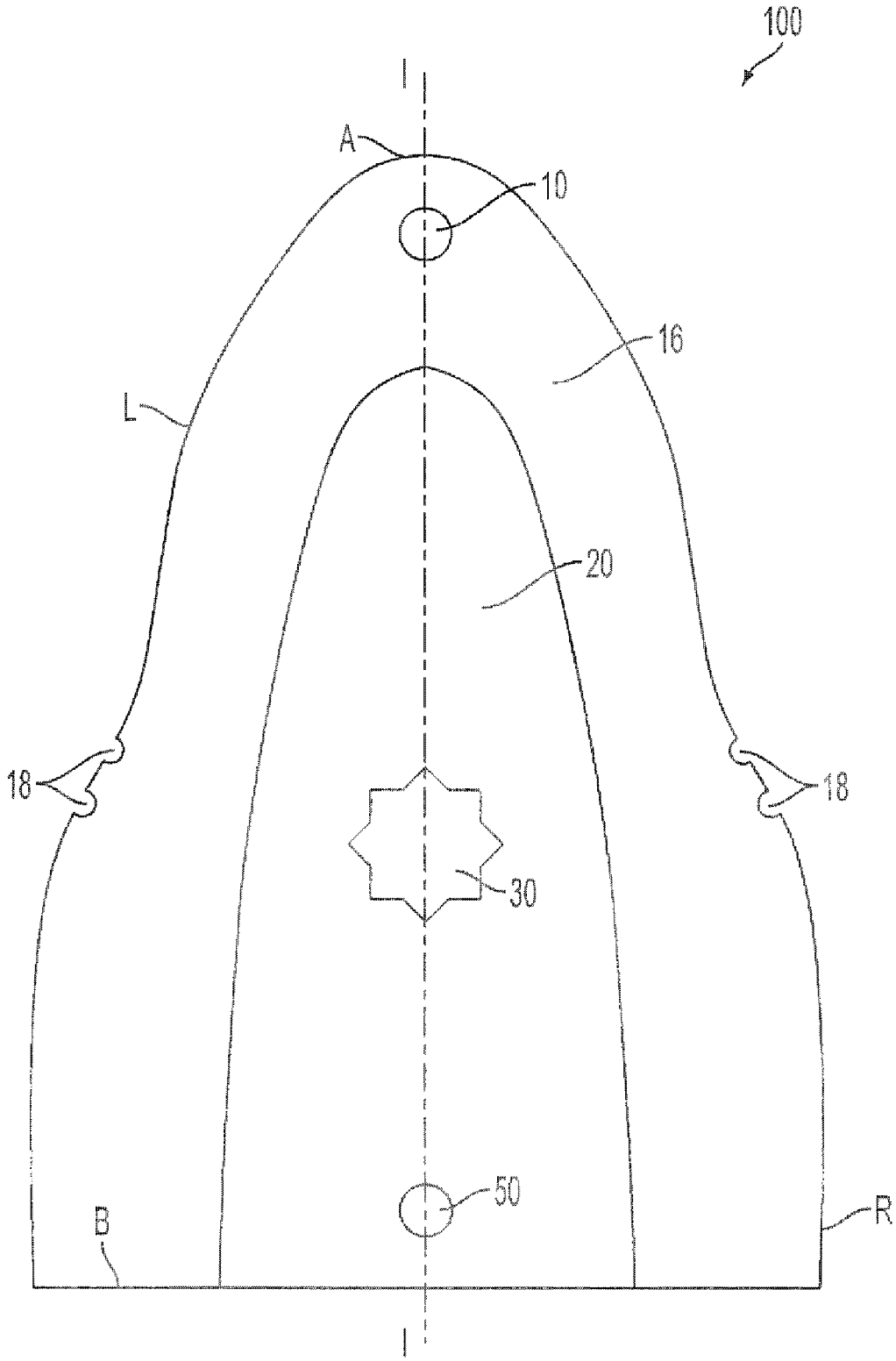
FIGS. 1A and 1B illustrate a top and a side view of a surf perch, respectively, according to an embodiment of the present application.

Embodiments of the present invention will now be described more fully with reference to the accompanying drawings, in which the embodiments are shown. The present invention may, however, be embodied in many different forms and should not be construed as being limited to the embodiments set forth herein; rather, the embodiments are provided so that this disclosure will be thorough and complete, and will fully convey the concept of the invention to one skilled in the art. In the drawings, the dimensions and regions are exaggerated for clarity. Like reference numerals in the drawings denote like elements, and thus, their description will not be repeated.

Accordingly, while embodiments of the invention are capable of various modifications and alternative forms, only the embodiments thereof are shown by way of example in the drawings and will herein be described in detail. It should be understood, however, that there is no intent to limit embodiments of the invention to the particular forms disclosed, but on the contrary, embodiments of the invention are to cover all modifications, equivalents, and alternatives falling within the scope of the invention.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of embodiments of the present invention. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "on" versus "directly on", "between" versus "directly between", "adjacent" versus "directly adjacent", etc.).

The terminology used herein is for the purpose of describing particular embodiments only and is not intended to be limiting of embodiments of the invention. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the Figs. For example, two Figs. shown in succession may in fact be executed substantially concurrently or may sometimes be executed in the reverse order, depending upon the functionality/acts involved.

Although the embodiments of the present invention have been disclosed for illustrative purposes, those skilled in the art will appreciate that various modifications, additions and substitutions are possible, without departing from the scope and spirit of the invention as disclosed in the accompanying claims.

A surf perch in the embodiments as illustrated in the present application is a flotation device configured to receive a surfboard, although the surf perch can be used in other water environments and for other purposes. The device permits a user to insert a surfboard therein from the back by tilting the back rest such as shown in FIGS. 7A-7D, allowing the user to sit/float in an anchored position in the water while he/she awaits a satisfactory wave. In preferred embodiments, the surf perch is configured to allow a person in a body of water to place or paddle a surfboard onto the top of the device. The surf perch device may be in a fixed or anchored position in the body of water. The surf perch is configured to permit the person to sit or lay on the surfboard out of the water on top of the surf perch, while the surf perch floats in or on the water.

Figure 1B:
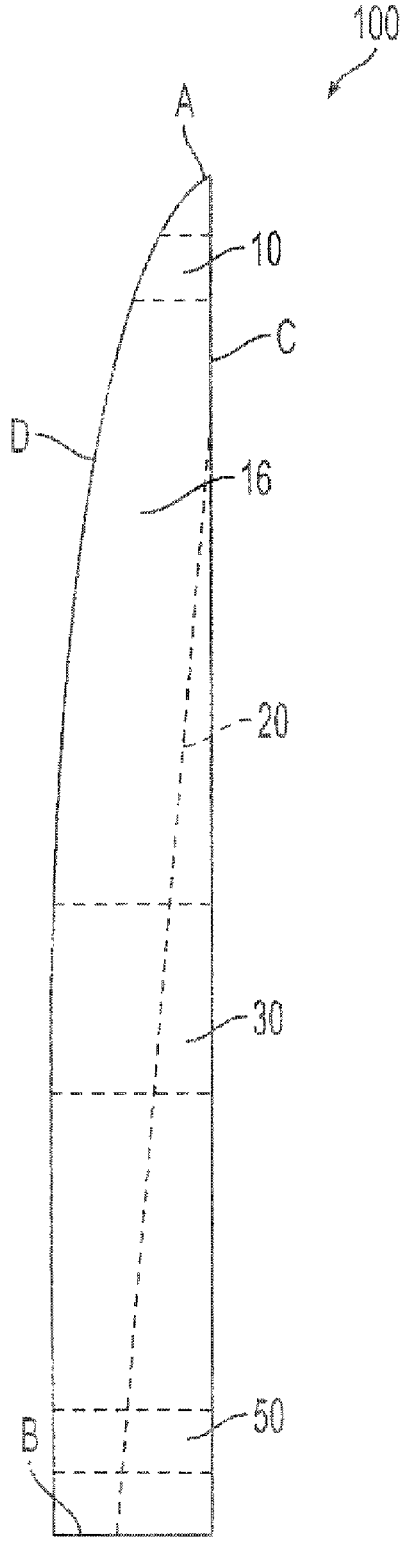

FIGS. 1A and 1B respectively illustrate a side view and a top view of a surf perch 100 according to a first embodiment of the present application. According to this embodiment, the surf perch 100 may include a main body 16. The main body 16 may be a single element configured to be a streamlined shape or a bullet shape with a front side A, a rear side B, an upper side C, a bottom side D, a left side L, and a right side R, wherein the bottom side D may be curved up at the front side A and each of the left and right side L and R may optionally have two adjacent indentations 18. The main body 16 is designed to float in water and may be in a fixed or anchored position. Alternatively, the main body 16 may also be configured to any other shapes suitable for surfing on the water.

The main body 16 may be symmetric to a centerline I-I. Along the centerline I-I there may be provided a deck section 20. The deck section 20 may be downwardly slanted from the front side A to the rear side B, and the deck section 20 may be a streamline shaped or be configured to accommodate a surfboard on the main body 16.

In the front side A of the main body 16, there may be provided a bowline hole 10 therethrough. The bowline hole may be positioned in the centerline I-I of the main body 16. In the rear side B of the main body 16, there may be provided a stern line hole 50 therethrough. The stern line hole may be positioned in the centerline I-I of the main body 16.

In the middle portion of the main body 16, there may be provided a mooring line hole 30 therethrough. The mooring line hole 30 may be positioned in the centerline I-I and in surf perch 100 may be star-shaped or may be polygonal. For example, the mooring line hole 30 may be an octagonal hole or may be a star-shaped hole with eight recesses. As a result, the bowline hole 10 and the mooring line hole 30 may form an anchor line-mooring hole system.

Figure 2A:
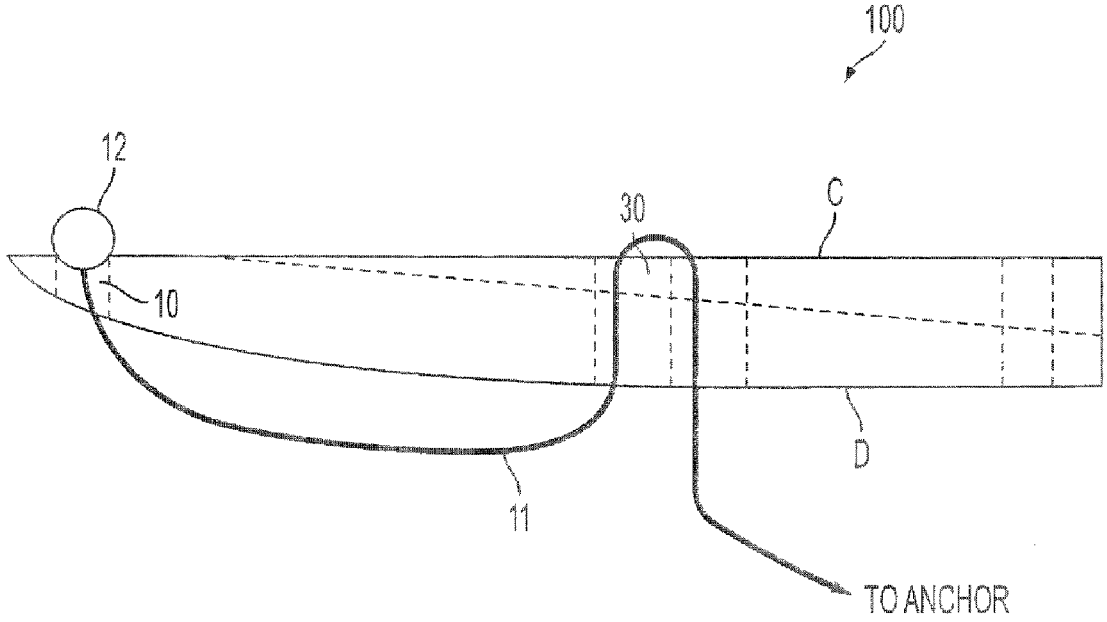
FIGS. 2A and 2B illustrate a method of anchoring the surf perch.
Figure 2B:
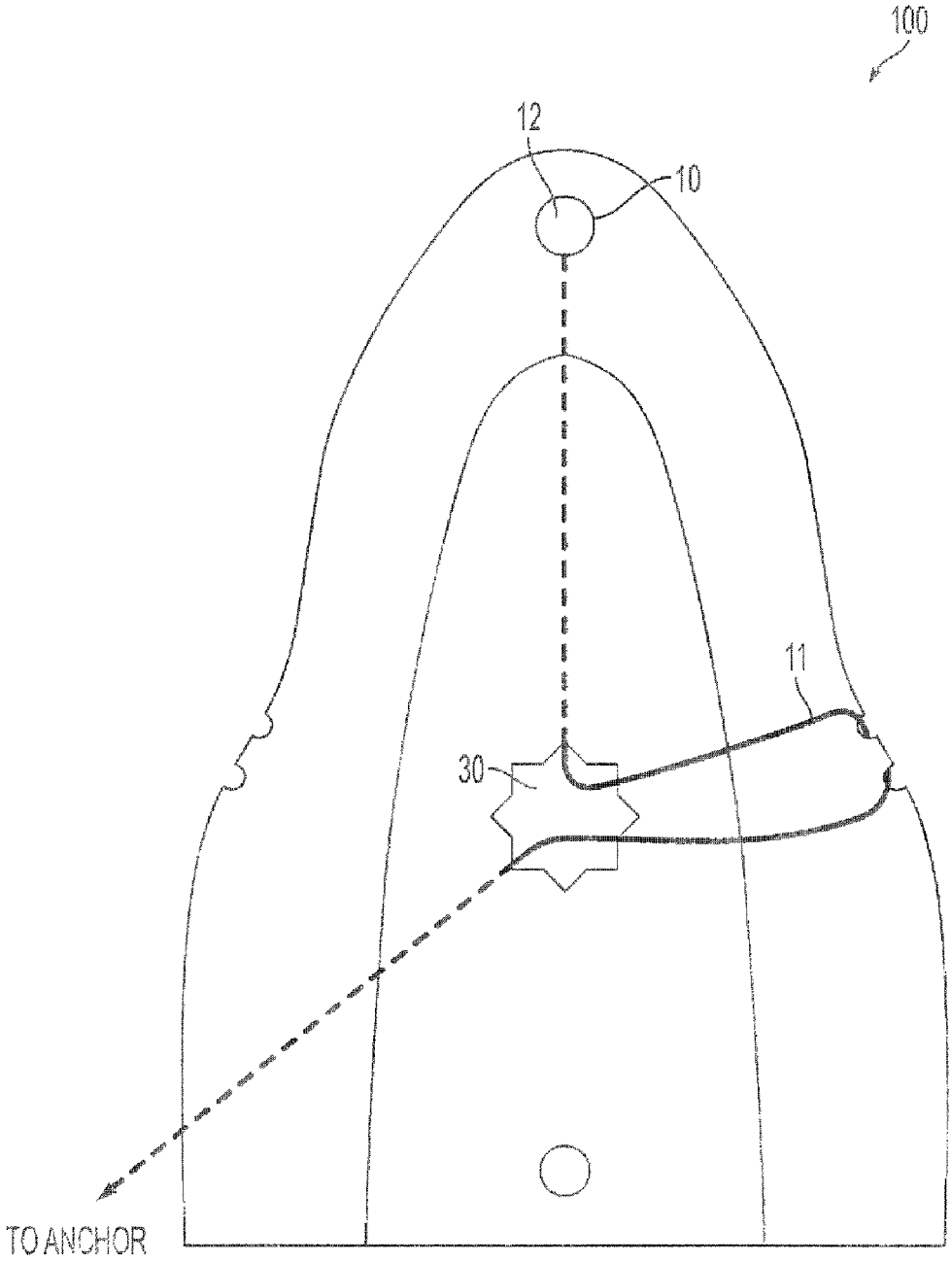

FIGS. 2A and 2B illustrate how the anchor line-mooring hole system functions. To anchor the surf perch 100, one end of a cable 11 (i.e., anchor line or rope) may first be tied to and go through the bowline hole 10 (or alternatively through the stern line hole 50) from the upper side C to the bottom side D of the main body 16, and then the cable 11 may go under the main body 16 and brought back to the upper side C of the main body through the mooring line hole 30, and then secured by going around any suitable object or objects of the main body 16 (e.g., go through the indentations 18 of the main body 16), and then go back down to the lower side D of the main body 16 through the mooring hole 30, and then the cable 11 may be fixed to a deck or anchored in the water. With the cable 11 secured through the mooring line hole 30, the surf perch can rotate or be controlled to rotate to any angle with respect to the direction of the cable line 11. The cable 11 may have a knot 12 bigger than the bowline hole 10 on the other end to prevent the cable 11 from slipping though the bowline hole 10. Because the mooring line hole 30 is polygonal or star-shaped, which has recesses along the peripheral thereof, the cable may rest in one of the recesses when passing through the mooring line hole 30. Therefore, the anchor line may have a fixed angle relative to that of the surf perch 100, i.e., the surf perch may stay at the same position with a roughly fixed orientation in the water.

Figure 3A:
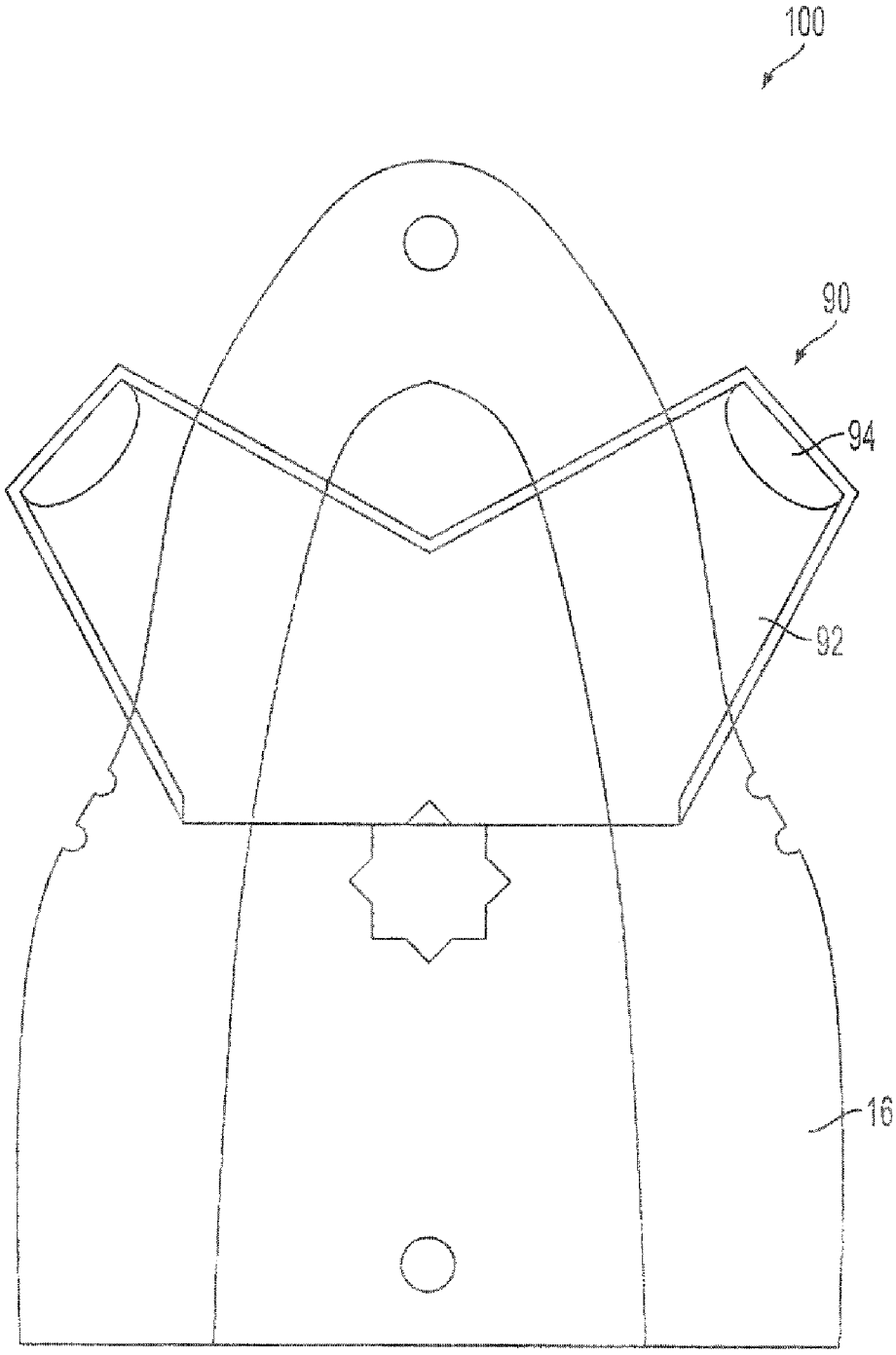
FIGS. 3A and 3B illustrate a side view and a top view of the surf perch including a pair of chaps, respectively, according to the embodiment of the present application.
Figure 3B:
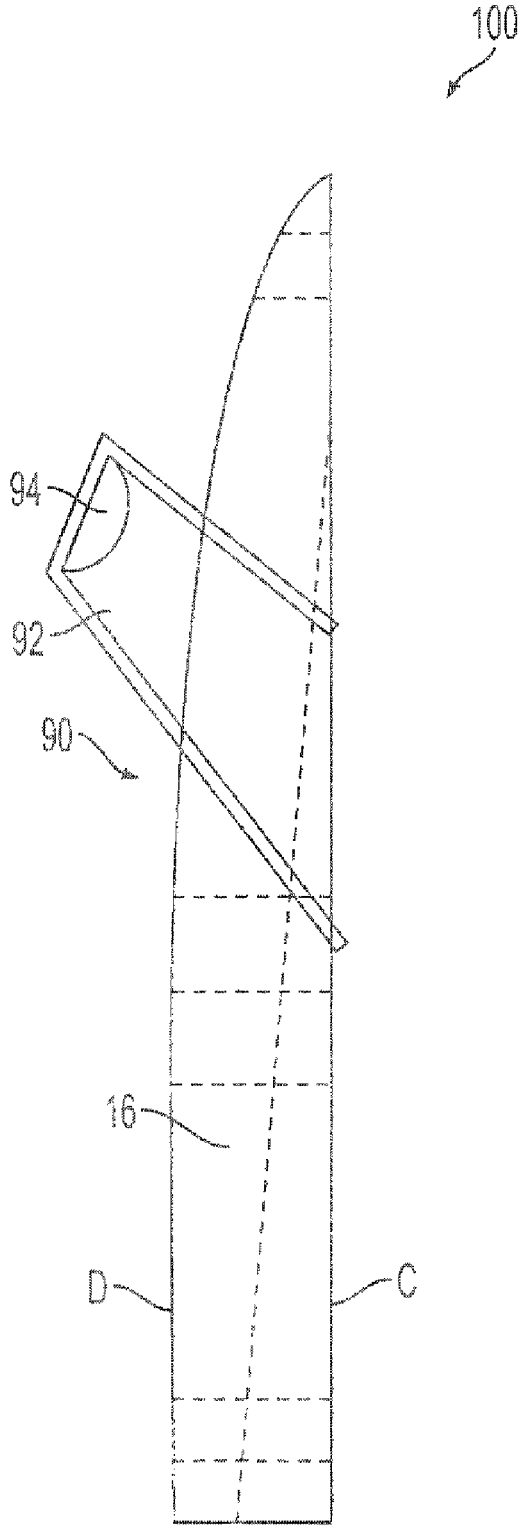
Figure 3C:
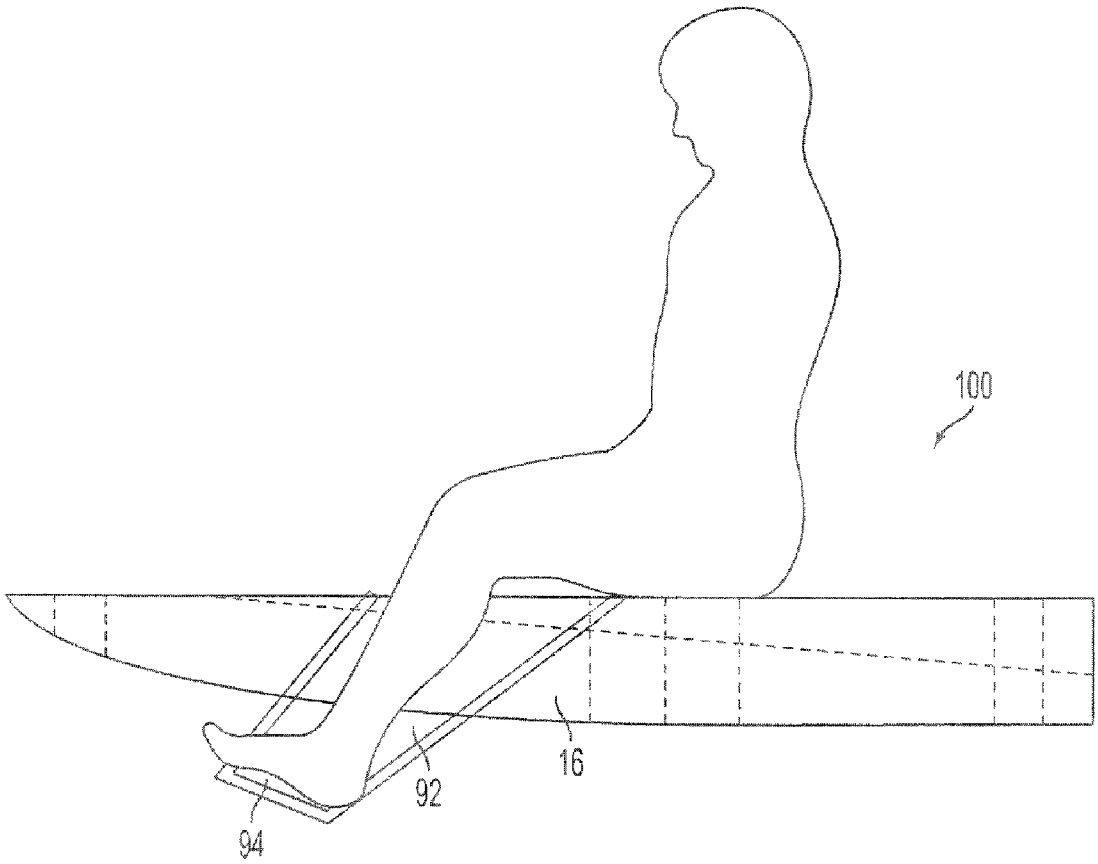
FIG. 3C illustrates how a person sits on the surf perch.

Referring to FIGS. 3A-3C, the surf perch 100 may also include a pair of chaps 90 so that the user can sit on top of a surfboard on the surf perch 100 and have his/her legs hanging down into the water. The chaps serve to protect the user's legs hanging in the water. According to FIGS. 3A and 3B, which are the top view and side view of the surf perch 100 having the pair of chaps 90 thereon, the chaps 90, also referred to as "Shark Flaps", may be attached on the upper side C of the main body 16 with two leggings 92 respectively hanging down from the left and right side L and R of the main body 16, where a user would hang his/her legs into the water. The leggings 92 may be considered analogous to that of cowboy chaps, but protecting the user's legs in the reverse side, i.e., instead of protecting the top of the legs, the leggings 92 may protect the bottom of the legs when the user rests on the surf perch 100. Each legging 92 may include a footrest 94 at the end, so that a user sitting on the surf perch 100 may secure his/her legs in the footrest 94, as illustrate in FIG. 3C.

Figure 4A:
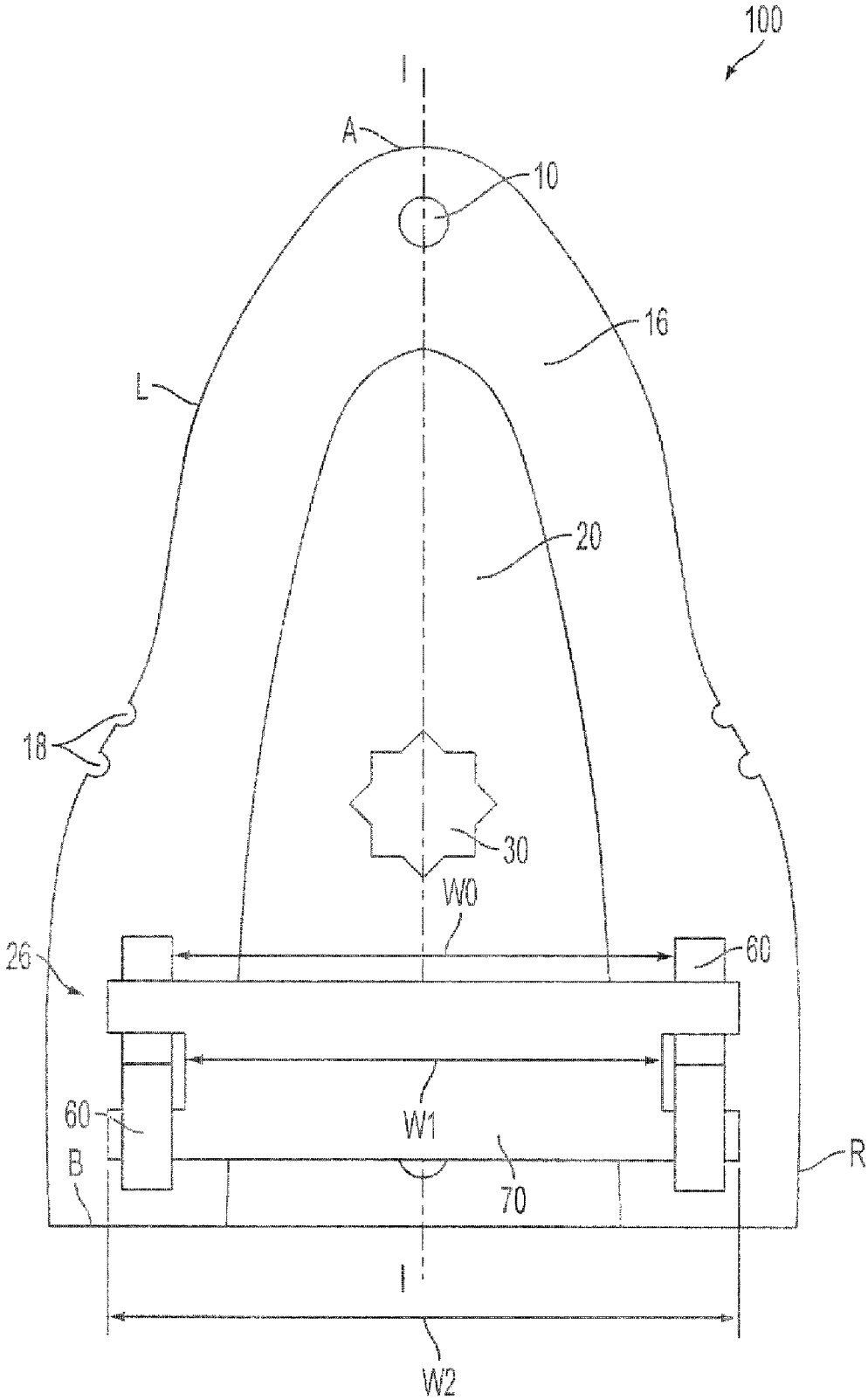
FIGS. 4A and 4B illustrate the top and side views of the surf perch including a backrest assembly, according to the embodiment.
Figure 4B:
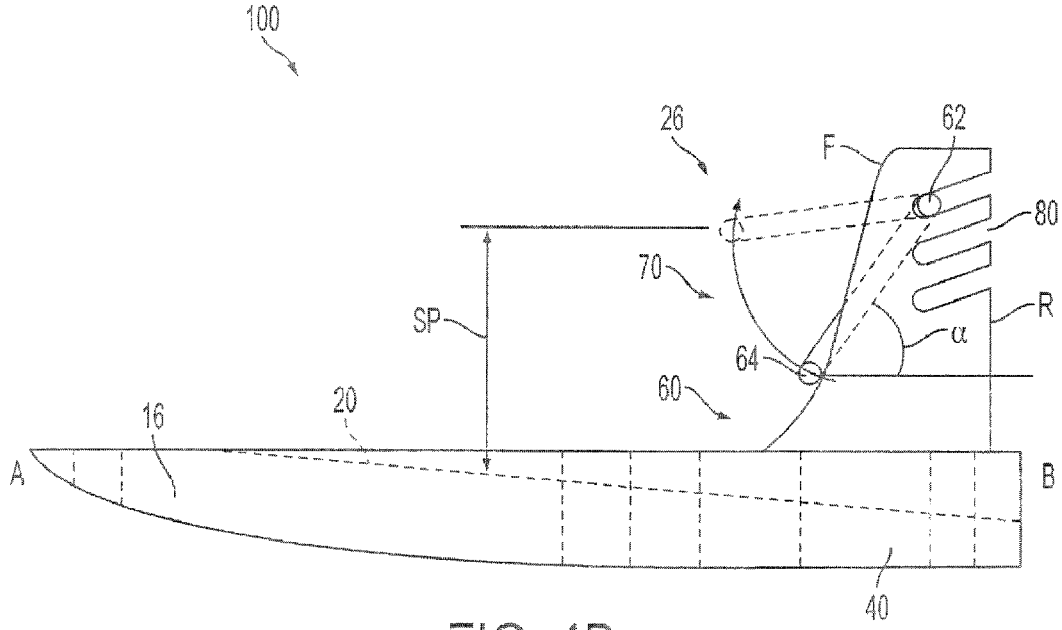
Figure 4C:
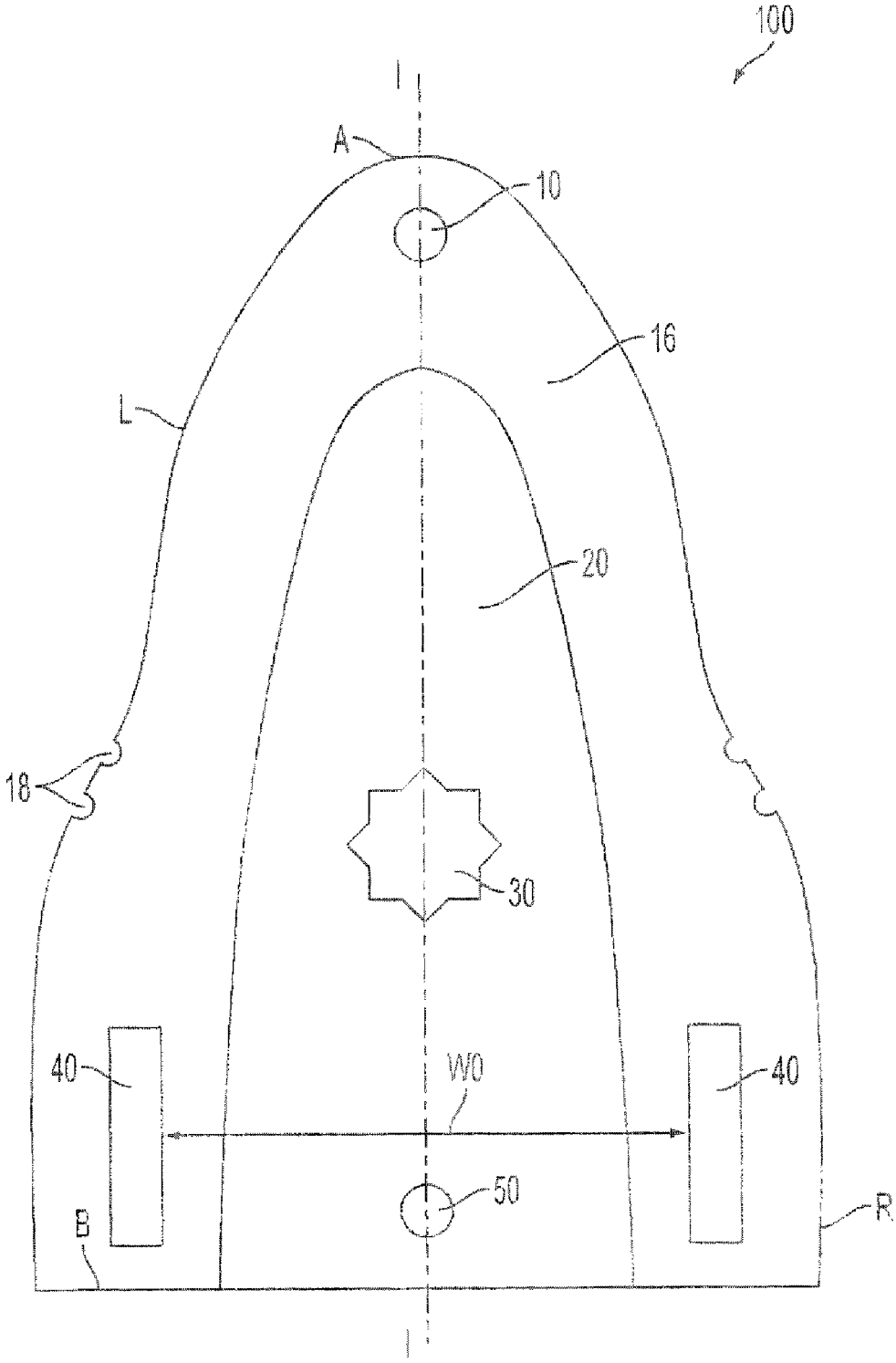
FIG. 4C illustrates the top view of the main body of the surf perch, including two backrest support slots.

Referring to FIGS. 4A-4C, the main body preferably also includes a backrest assembly. FIGS. 4A and 4B respectively illustrate the top view and side view of the surf perch 100 with the backrest assembly 26. As shown in FIG. 4A, the backrest 26 may include one backrest 60 and two backrest supports 70 erected on the main body 16. Accordingly, the main body 16 may further include two backrest support slots 40 positioned symmetrical to the centerline I-I, as shown in FIG. 4C.

FIG. 4C is the top view of the main body 16 with the two backrest support slots 40. According to FIG. 4C, the backrest support slots 40 may be arranged close to the rear side B of the main body 16. It may be rectangular holes through the main body 16 or any other shapes suitable for a backrest support 70. The width W0 in FIG. 4C denotes a width of the space between the two backrest support slots 40. The width W0 may be greater than a width of the deck section 20.

Figure 5:
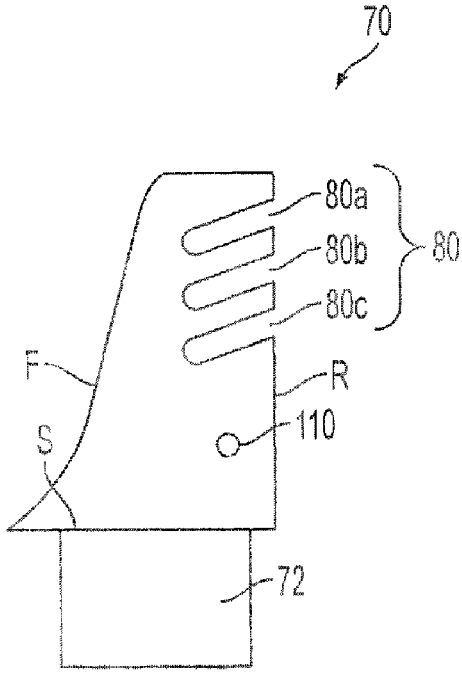
FIG. 5 shows a backrest support of the surf perch, according to the embodiment.

FIG. 5 shows the backrest support 70 according to an embodiment of the present application. According to the arrangement of FIG. 5, the backrest support 70 may include a downwardly extending tenon 72, an upper portion 74, and a horizontal bottom stop surface S that divides the tenon 72 from the upper portion 74. Other connecting mechanisms can instead be used.

To assemble with the main body 16, two backrest support 70 may be needed corresponding to the two backrest support slots 40. The tenon 72 may be configured to have a same shape as, but with a slightly smaller dimension than, that of the backrest support slots 40, so that the corresponding tenons 72 may be inserted into the backrest support slots 40, respectively, with little or more frictional retention. After assembly, the stop surface S may contact the upper side A of the main body 16, and each of the backrest supports 70 may be perpendicular to the main body 16.

The upper portion 74 may includes a front side F and a rear side R. The front side F may be a curved line and the rear side R may be a straight line. Alternatively, the front side F may also be a straight line non-parallel to the rear side R.

A plurality of adjustment slots 80 may be formed from the rear side R towards the front side F. For example, three adjustment slots 80*a*, 80*b*, 80*c* may be formed in the upper portion 74. They may start from the rear side R and extend downwardly towards, but do not reach, the front side F, and may be parallel to each other, so that the adjustment slot 80*a* may be higher than the adjustment slot 80*b*, and the adjustment slot 80*b* may be higher than the adjustment slot 80*c*.

Figure 6:
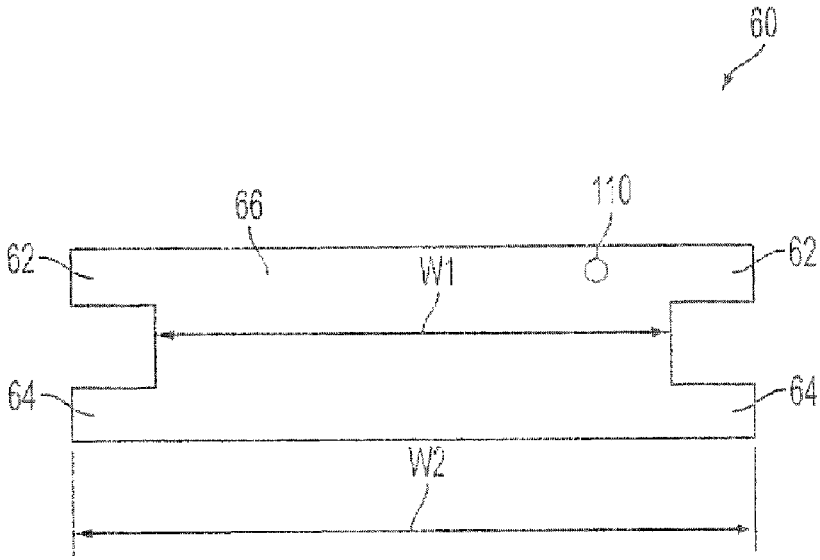
FIG. 6 shows a backrest of the surf perch, according to the embodiment.

FIG. 6 shows a backrest 60 according to the first embodiment of the present application. The backrest 60 may be an H shape, i.e., the backrest 60 may include a rectangular main portion 66 and four protrusions respectively extended from the four corners of the rectangular main portion 66. The main portion 66 may have an upper edge, a lower edge, and two side edges. The width between the two side edges may be W1. Two identical upper protrusions 62 may respectively extend from the side edges along the upper edge, and two identical lower protrusions 64 may respectively extend from the side edge along the lower edge. The upper and lower protrusions 62 and 64 may extend to a width W2.

Referring back to FIGS. 4A and 4B, where the backrest 60 is assembled between the backrest supports 70. As shown in these figures, the width W1 may be smaller than the width W0, and the width W2 may be greater than the width W0. Further, a cross-section of the upper protrusions 62 may be configured to be able to sit in the adjustment slots 80, so that when assembled, the upper protrusions 62 may sit in the corresponding adjustment slots 80 and the lower protrusions 64 may lean on the front side F of the backrest supports 70. Because the adjustment slots 80 do not reach the front side F, the upper protrusions 62 may stay in the slots and the backrest 60 may naturally form a reclining angle $\alpha$ with respect to the upper side C of the main body 16. Also because the front side F is not parallel to the rear side R, the corresponding reclining angle $\alpha$ may differ when the upper protrusions 62 sit in different adjustment slots 80*a*, 80*b*, or 80*c*. Accordingly, the main portion 66 may serve as a backrest to allow a user sitting on the surf perch 100 and recline against the backrest, and the height and reclining angle $\alpha$ of the backrest may be adjusted by putting the upper protrusions 62 in different adjustment slots 80*a*, 80*b*, or 80*c*.

Figure 7A:
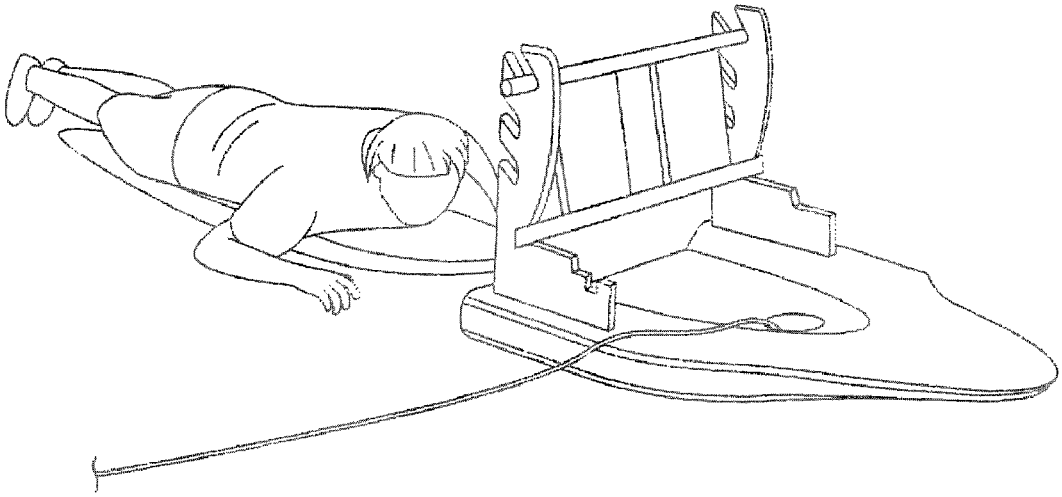
FIGS. 7A-7D illustrate how a surfer on his board enters the surf perch from the rear.
Figure 7B:
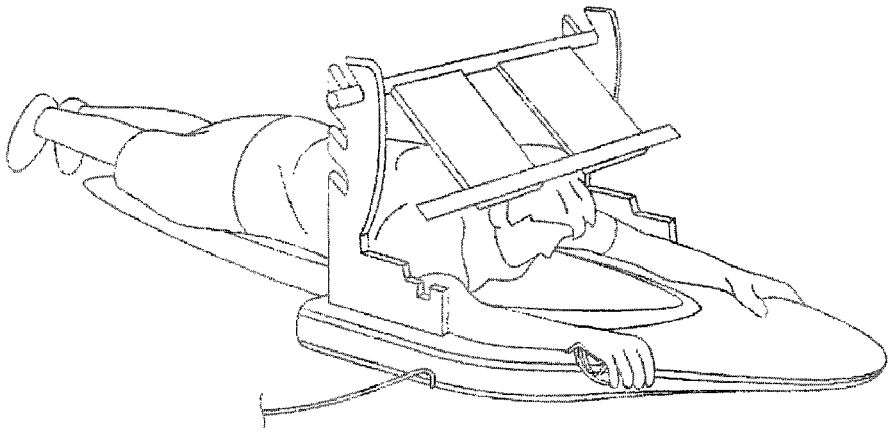
Figure 7C:
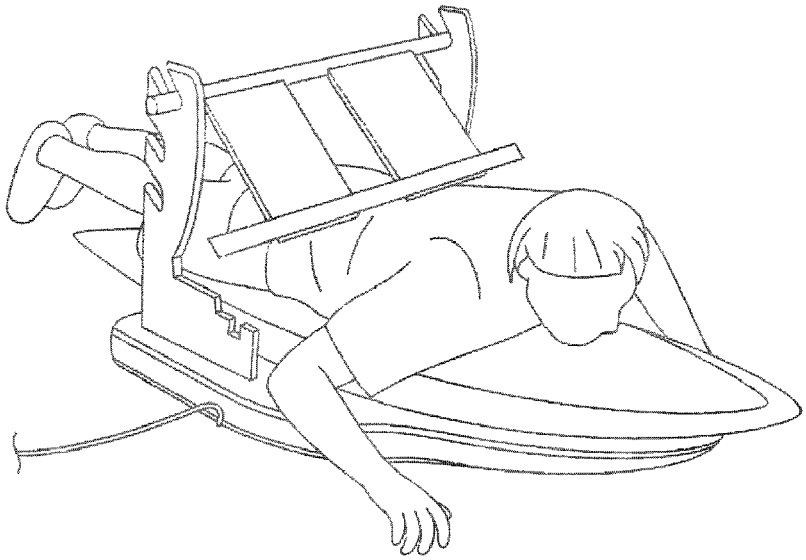
Figure 7D:
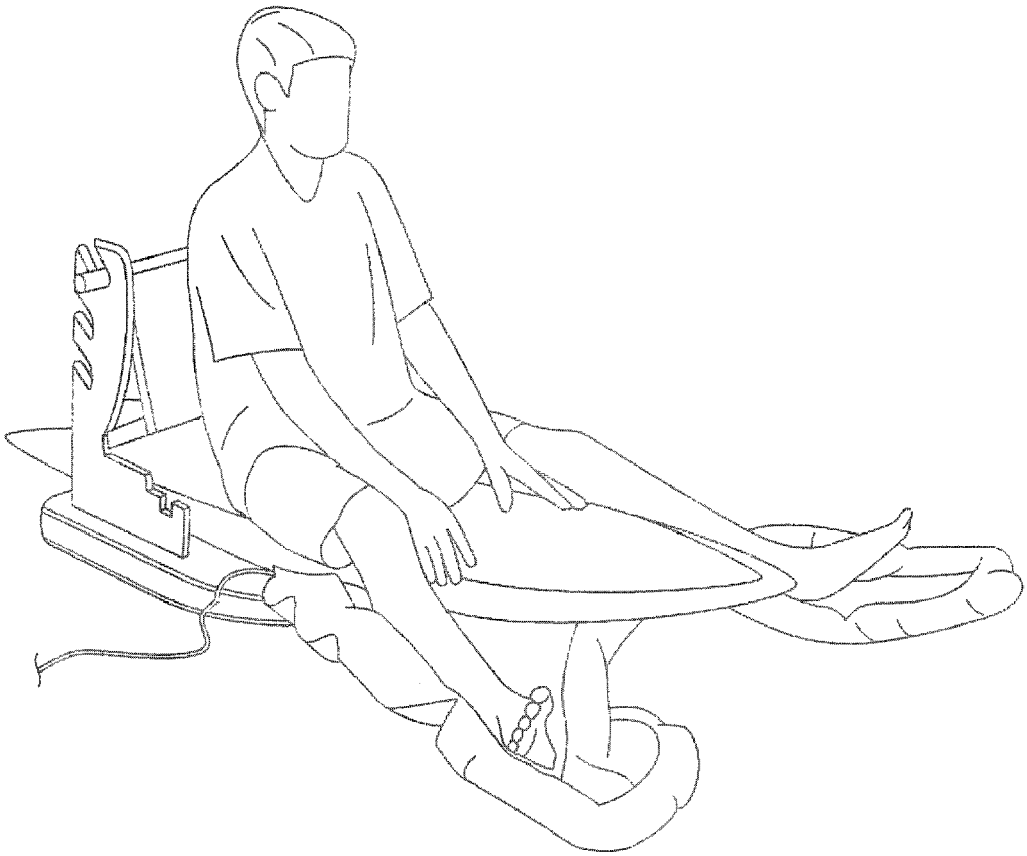
Figure 8:
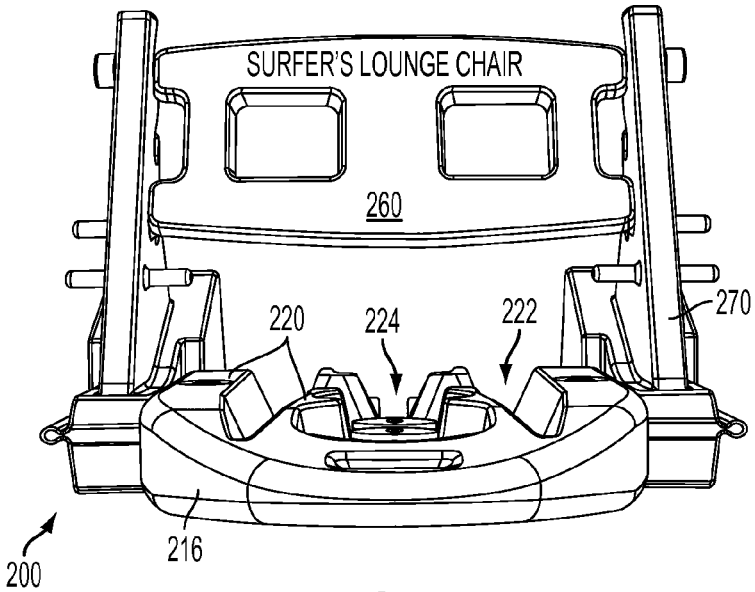
FIG. 8 is a front perspective view of a second embodiment of the surf perch.
Figure 9:
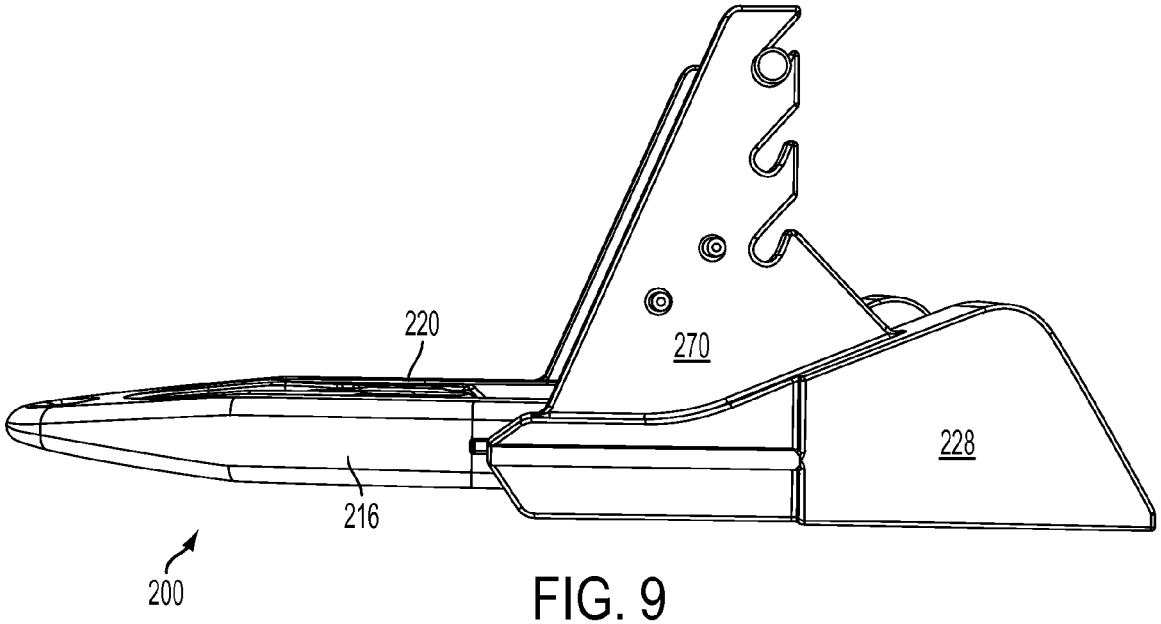
FIG. 9 is a left side perspective view of the embodiment of FIG. 8.
Figure 10:
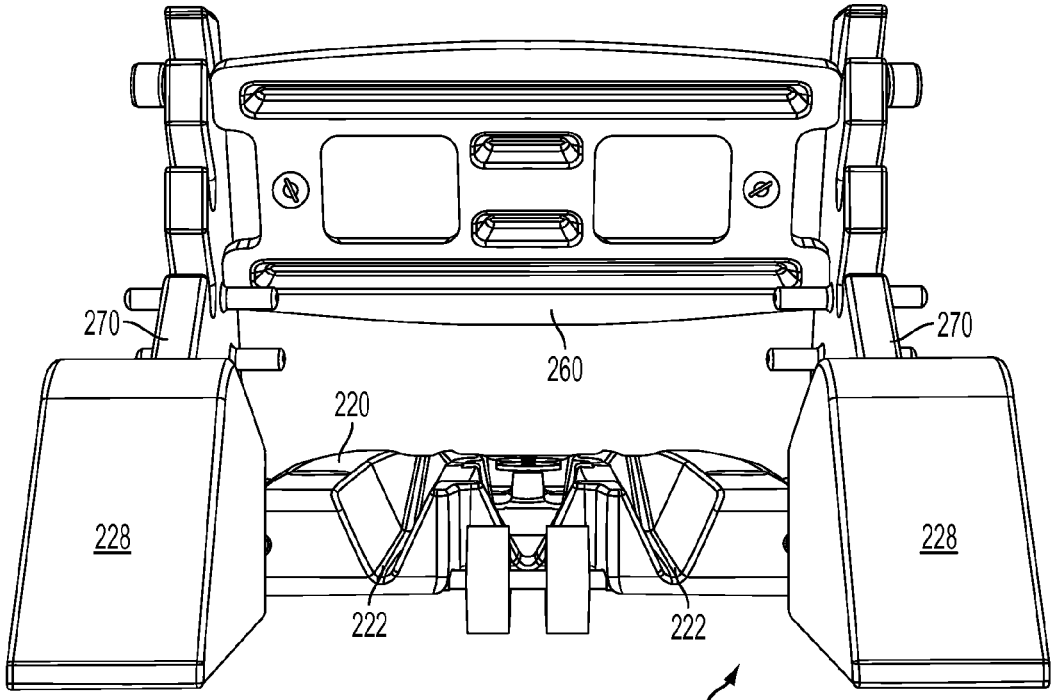
FIG. 10 is a rear perspective view thereof.
Figure 11:
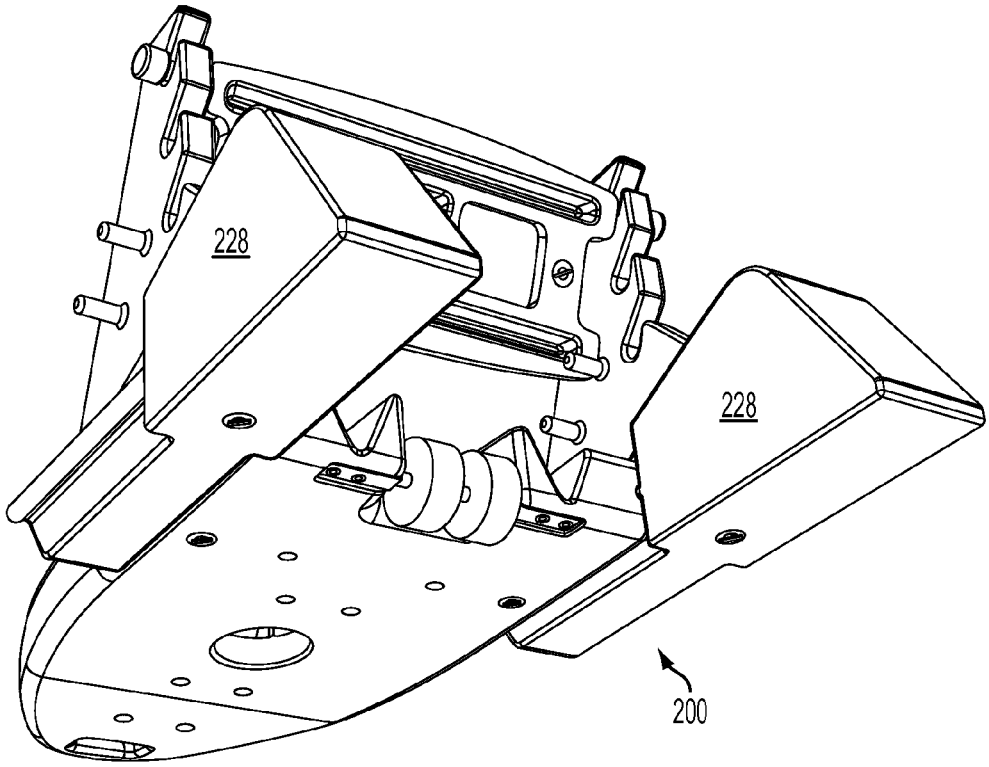
FIG. 11 is a perspective view from below, behind and from the left side of the embodiment of FIGS. 8-10.
Figure 12:
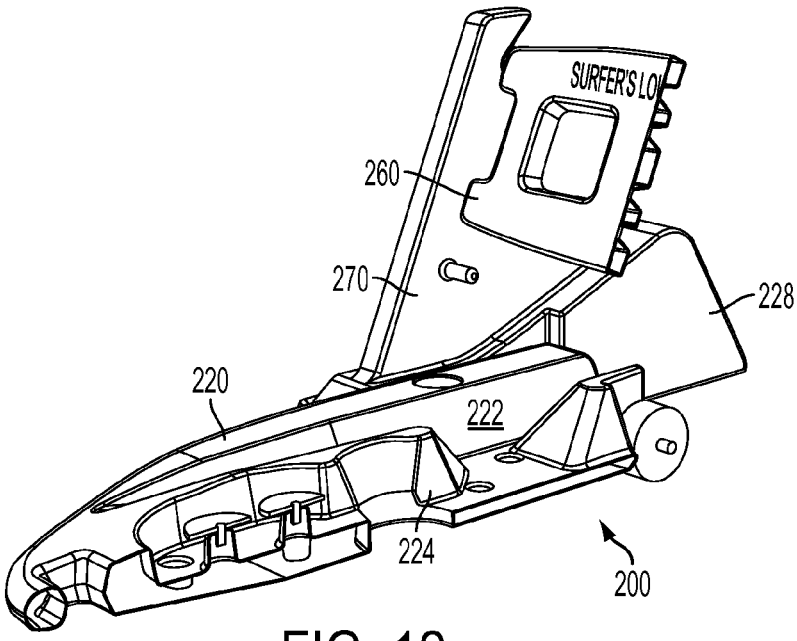
FIG. 12 is a perspective view cut through the center line showing the right side half of the embodiment of FIGS. 8-11.
Figure 13:
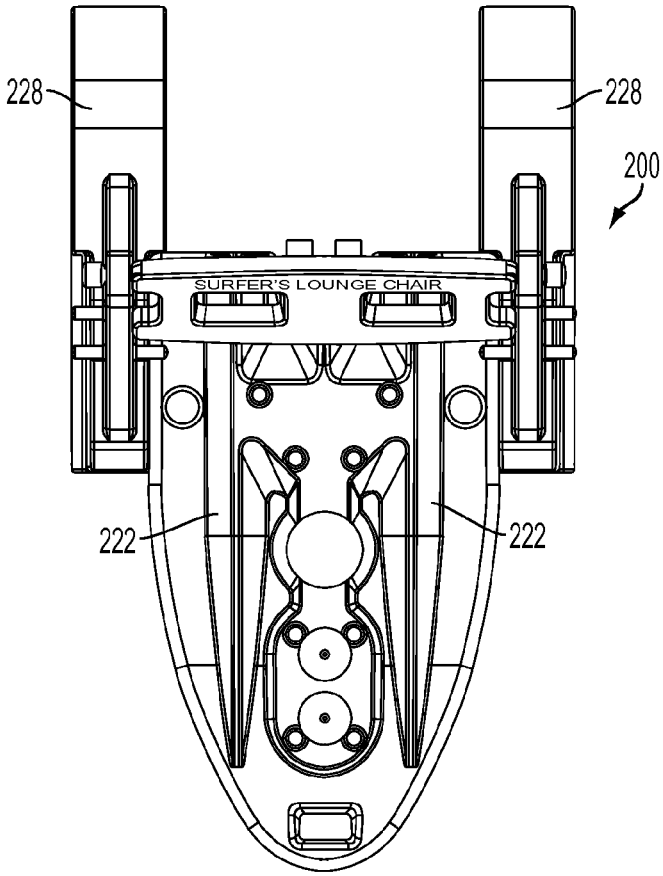
FIG. 13 is a top plan view thereof.
Figure 14:
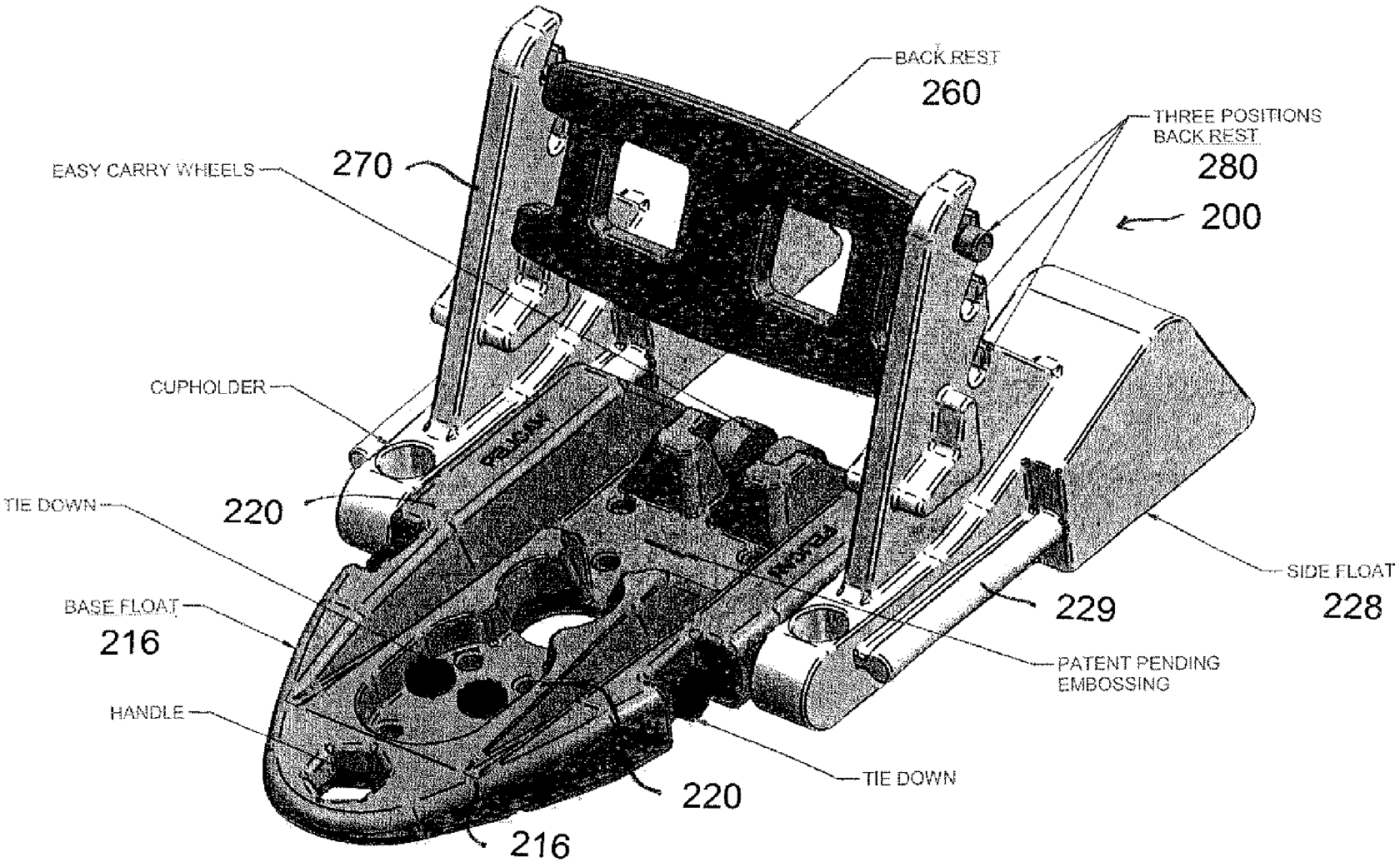
FIG. 14 is a top, front perspective view thereof.

Because the upper protrusions 62 sit in the adjustment slots 80 and the lower protrusions 64 are free from constraint above the front side F, the backrest 60 may be rotated upward to leave the space SP between the lower protrusions 64 and the deck section 20 open for the user to place a surfboard from the water on top of the surf perch. Thus, in one embodiment, the user who is laying on the surfboard in the water (positioned behind the surf perch as shown in FIG. 7A) may paddle the surfboard up onto the rear end B of the surf perch and under the bottom of the backrest as the backrest rotates upward so the person on the surfboard passes underneath and moves on top of the surf perch as shown in FIGS. 7B and 7C, finally reaching a sitting position as shown in FIG. 7D. In other words, the user paddles under the bottom of the backrest as it rotates up, and the user moves on top of the surf perch. This may allow the user to lay prone on the main body 16 to extend his/her feet into the water from the rear side B thereof to paddle. When the user wants to switch from the prone position to sit on the surf perch 100, he/she may crawl from the rear side B towards the front side A, let the backrest 60 swing down into a position where the user can sit up and recline against the backrest 60.

In one embodiment, the surf perch can be operated and used without the backrest assembly mounted on the surf perch, in which case the user lays or sits on the surfboard on top of the surf perch without a back support to recline on.

In another or the same embodiment, the back rest assembly is configured to come apart when it is hit by large waves. One or more holes 110 can be placed in each piece of the best rest to tie each piece to the surf perch, so they are not lost if they are knocked off the perch by a wave.

According to the embodiments of the present application, the surf perch 100 may allow a user to rest on it to wait for a wave. When the wave comes, the user may be able to slide off the surf perch 100 with the surfboard to catch and surf on the wave. Once the wave ride has ended, the user may return to the surf perch 100 to wait for the next waive. To this end, the anchor line-mooring hole system may ensure the surf perch 100 remaining in the same anchored place and orientation in the water.

As set forth above, the above described embodiments of the present application may include a surf perch having a main body with a backrest assembly thereon, so that a user may sit on the surf perch to wait for a wave. These embodiments may also include an anchor line-mooring hole system to ensure the surf perch remain in the same anchored place and orientation in the water.

Embodiments of the surf perch according to the present invention are of course adapted to float. The parts can be made of materials which have a density less than water, e.g. wood or better yet, polypropylene. However, various parts are more desirably made hollow, and therefore buoyant, or the hollow parts may be filled with foam plastic, or the body itself may be made of cellular material.

FIGS. 8-16B show a more advanced form or embodiment 200 of the surf perch, the basic parts of which are equivalent or at least similar to the embodiments described above. Accordingly, the following description will emphasize differences between the embodiments 200 and the embodiments 100 described above, with focus on those differences which are presently considered to be of greater significance.

In the surf perch 200, the upper or deck portion to 20 of the main body 216 is substantially horizontal rather than sloped, and is desirably provided with at least two side grooves 222, and preferably also a centrally located groove 224, the grooves being adapted to receive therein the downwardly projecting fins which are usually provided on surfboards.

Figure 16A:
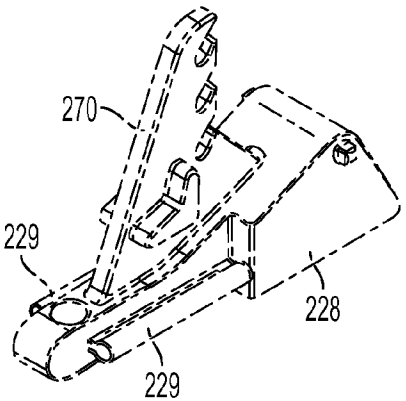
FIG. 16A is a front perspective view of the separable right side back support and float element.
Figure 16B:
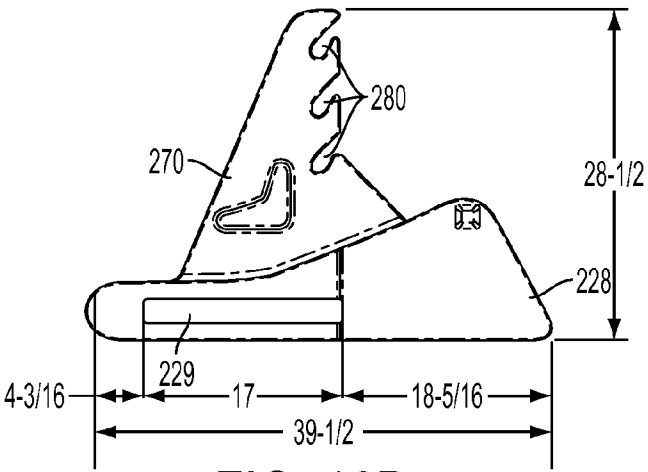
Figure 15A:
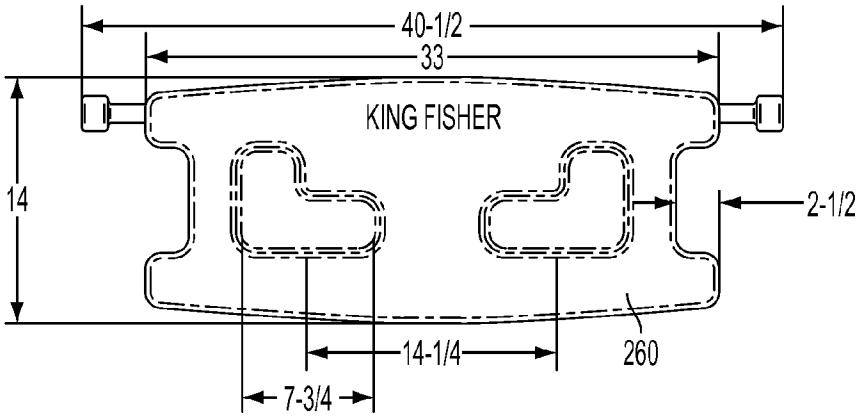
FIG. 15A is a front view of the pivotable backrest and FIG. 15B is a front perspective view thereof.
Figure 15B:
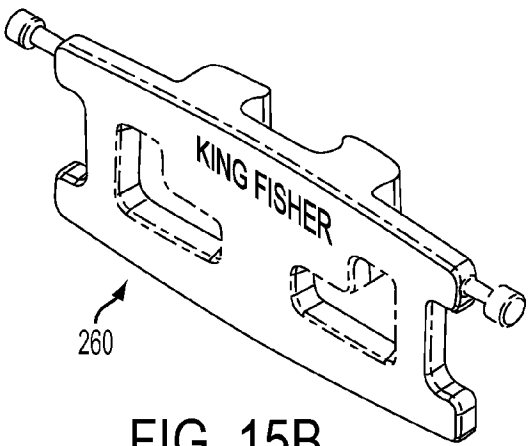

To improve the stability of the surf perch, the embodiment 200 is provided with additional float sections 228, each also being referred to as a side float, located at the back of the surf perch 200, to which are connected the back rest supports 270 which project upwardly therefrom and which are preferably integral therewith. The float sections 228 with the back rest supports 270 integral therewith are desirably each connected to the main body 216 by a rod-like structure 229 as best seen in FIGS. 16A and 16B which are slidingly received within corresponding channels in the main body 216. Each float section 228 is provided with two such rod-like connecters so that it can be used on either side of the main body or base float 216, to avoid the necessity of having a left side float 228 and a right side float 228 which are different from one another, and to also avoid the added cost of making minor-image components. The back rest supports 270 are desirably each provided with three separate back rest support slots 280, as described above relative to the embodiments 100. As can be readily seen, the back rest 260 is supported at its upper end and it therefore free to swing upwardly to permit entry of the user and surf board from the back, as already described above and as best shown in FIGS. 7A-7D.

As indicated above, the various parts of the surf perch in its various embodiments, e.g. 100 and 200, can be made from a variety of materials. Most desirably, however, the various parts are made of strong plastic, hollow for buoyancy, which strong plastic can be selected from a variety of so-called engineering plastics for durability, although other plastics can also be used such as vinyl plastics, polypropylene, etc.

Although the embodiments have been particular shown and described with references to FIGS. 1-16B, it will be understood by one of ordinary skill in the art that various changes in form and details may be made therein without departing from the spirit and scope of the present invention, as broadly defined by the following claims. For example, although the back rest is shown to pivot upwardly about a horizontal axis, it could alternatively be made to open sideways about a vertical axis or two vertical axes.

The foregoing description of the specific embodiments will so fully reveal the general nature of the invention that others can, by applying current knowledge, readily modify and/or adapt for various applications such specific embodiments without undue experimentation and without departing from the generic concept, and therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent of the embodiment or embodiments disclosed in the specification above, i.e., other means or steps for carrying out the same functions can be used; and it is intended that such expressions be given their broadest interpretation.

What is claimed is:

1. A surf perch comprising:

a main body having a streamline shape symmetric to a centerline thereof and comprising a front side, a rear side, an upper side, a bottom side, a left side, and a right side;

a first hole in a middle portion of the main body therethrough, a back rest support attached to the main body, said back rest support extending upwardly from said main body, and a swingable back rest having an upper edge and a lower edge and connected at a location of the back rest that is closer to the upper edge than the lower edge to the back rest support and adapted to swing upwardly relative to the back rest support to provide an upwardly swung backrest and an opening therebelow to permit a surf board and surfboarder to enter the surf perch from the rear side below the upwardly swung back rest.

2. The surf perch of claim 1 further comprising an anchor line and an anchor, wherein the anchor line extends upwardly as a loop through the first hole, the loop being adapted to be attached at or along the upper side.

3. The surf perch of claim 1 having at least one longitudinally extending groove in the upper side, the groove being of size and shape adapted to slidingly receive a fin of a surf board.

4. The surf perch of claim 3 comprising a plurality of grooves adapted to slidingly receive fins of a surf board.

5. The surf perch of claim 1, further comprising a pair of chaps attached on the upper side of the main body, wherein the pair of chaps has two leggings respectively hanging down from left and right sides of the main body.

6. A surf perch comprising a main body adapted to and capable of floating on water;

a first hole located approximately at a middle portion of the main body and extending therethrough;

a tether connected at a first end thereof to the main body and extending downwardly through the hole;

an anchor connected to the tether at a second end of the tether;

a pair of backrest supports extending upwardly from the main body near the rear end thereof, the back rest supports being positioned symmetrical to a center line of the main body with a space therebetween sufficient to permit the passage there through of a person; and a backrest having an upper edge and a lower edge and rotatably connected at a location of the back rest that is closer to the upper edge than the lower edge to said back rest supports adjacent upper ends of the back rest supports, whereby the backrest is capable of swinging upwardly relative to the back rest supports by a person entering the surf perch from the rear between the backrest supports.

7. The surf perch of claim 6, further comprising a pair of chaps attached on the upper side of the main body, wherein the pair of chaps has two leggings respectively hanging down from left and right sides of the main body.

8. The surf perch of claim 1 wherein the backrest support is releasably attached to the main body.

9. The surf perch of claim 1 wherein said first hole is star-shaped.

10. The surf perch of claim 1 wherein the main body has a front portion and a rear portion, the front portion having a width which is less than the width of the rear portion;

the backrest support comprises two upright members having a space therebetween that is wider than the width of the front portion of the main body;

the two upright members of the backrest support are close to a rear portion of the main body; and the backrest support upright members comprise angle adjustment slots, each angle adjustment slot extending from a closed rear part upwardly to an open front part.

11. A surf perch comprising a main body adapted to and capable of floating on the surface of water;

the main body having a front end and a rear end, and an upper surface which slopes downwardly from said front end to said rear end;

a first hole located approximately at a middle portion of the main body and extending therethrough, the first hole having a series of alternating indentations and inwardly projecting ribs;

a tether connected at a first end thereof to the main body, and extending downwardly through the hole;

an anchor connected to the tether at a second end of the tether;

a pair of backrest supports extending upwardly from the main body near the rear end thereof, the back rest supports being positioned symmetrical to a center line of the main body with a space therebetween sufficient to permit the passage there through of a person; and a backrest having an upper edge and a lower edge and rotatably connected at a location of the back rest that is closer to the upper edge than the lower edge to said back rest supports adjacent upper ends of the back rest supports, whereby the backrest is capable of swinging upwardly relative to the back rest supports so that a person can enter the surf perch from the rear between the backrest supports and below the backrest.

12. The surf perch of claim 11, further comprising a pair of chaps attached on the upper side of the main body, wherein the pair of chaps has two leggings respectively hanging down from left and right sides of the main body.

* * * * *